United States Patent [19]

Eckstein

[11] Patent Number: 4,555,252

[45] Date of Patent: Nov. 26, 1985

[54] ELECTROSTATIC FILTER CONSTRUCTION

[75] Inventor: Wolfgang Eckstein, Sereetz, Fed. Rep. of Germany

[73] Assignee: Drägerwerk Aktiengesellschaft, Fed. Rep. of Germany

[21] Appl. No.: 594,104

[22] Filed: Mar. 28, 1984

[30] Foreign Application Priority Data

Jun. 4, 1983 [DE] Fed. Rep. of Germany ..... 3320299

[51] Int. Cl.[4] ..... B03C 3/12; B03C 3/45

[52] U.S. Cl. ..... 55/132; 55/146; 55/155

[58] Field of Search ..... 55/103, 131, 132, 138, 55/155, 156, 146

[56] References Cited

U.S. PATENT DOCUMENTS

| | | | |
|---|---|---|---|
| 2,297,601 | 9/1942 | Williams | 55/131 |
| 2,729,302 | 1/1956 | True | 55/132 |
| 3,053,028 | 9/1962 | Kayko | 55/103 |
| 3,446,906 | 5/1969 | Zulauf | 55/131 |
| 3,798,879 | 3/1974 | Schmidt-Burbach et al. | 55/131 |
| 4,185,972 | 1/1980 | Nitta et al. | 55/131 |
| 4,200,440 | 4/1980 | Renko | 55/131 |
| 4,317,661 | 3/1982 | Sasaoka et al. | 55/131 |

FOREIGN PATENT DOCUMENTS

| | | | |
|---|---|---|---|
| 112577 | 10/1978 | Japan | 55/155 |

*Primary Examiner*—David L. Lacey
*Attorney, Agent, or Firm*—McGlew and Tuttle

[57] ABSTRACT

Modern fiber material filters for floating particles remove floating substances from the air or gas flow conducted through them. In addition to the pure screening properties it is electrostatic forces, generated either by the flowing action or by accessory equipment, which make it possible to obtain the high degrees of separation, such as at least 99.97%, for example. An electrostatic filter for floating particles contains an electrode on each of the inlet and discharge sides. The electrostatic field through which the retaining ability is increased is generated by an oppositely polarized voltage. The floating particles filter according to the invention contains an electrode on the discharge side in the form of a metallic vapor deposit on the dielectric, folded filter material. This electrode retains every last floating particle which, above all, are then still located within the filter material itself, so that in case of a power failure, they cannot blow away.

1 Claim, 1 Drawing Figure

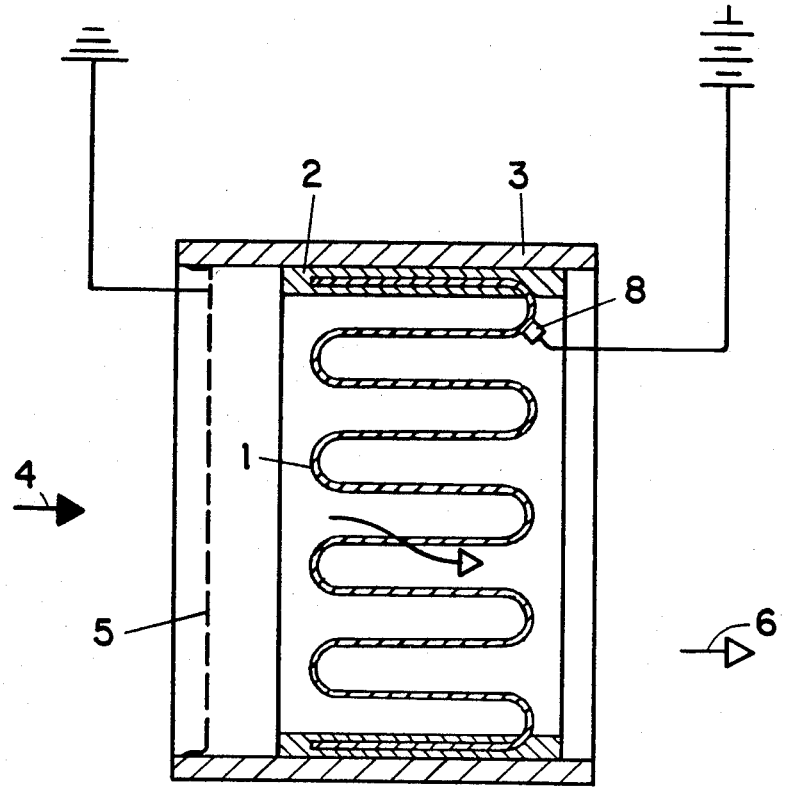
2
3
8
1
4
5
6

ELECTROSTATIC FILTER CONSTRUCTION

FIELD AND BACKGROUND OF THE INVENTION

This invention relates in general to the construction of filters and in particular to a new and useful electrostatic filter for floating particles which includes a folded dielectric filter material made of fiber with a metallic vapor deposit thereon.

Modern high efficiency filters for floating particles, made of fiber material, will remove from the air or other gas flow conducted through them, floating materials like dust, smoke and mists of different grain size. According to the pertinent regulations, the minimum degree of separation must be 99.97%. This applies to particles 0.3 $\mu$m in diameter. Despite the space between the fibers in the filter material, smaller particles are retained also. Among others, electrostatic forces within the filter material, generated either by the flow of the air or gas to be purified or by accessory equipment, are responsible for the retention of the particles in the filters.

One known electrostatic filter cell consists of a corrugated, air-permeable web of dielectric filter material, enclosed by a frame made of nonconducting material, usually cardboard. One side of the web is provided with an arrangement of conducting strips such as of aluminum or silver, applied by printing or spraying. The strips are parallel, equispaced and insulated against each other. At opposite edges of the web the strip ends are alternately interconnected via extended areas, resulting in two comblike groups whose teeth engage each other. Through contact pieces at the faces of the frame a dc voltage of opposite polarity is applied to both groups (German AS No. 14 07 019). However, in operation a bridging of the insulating gaps between the strips can occur due to conductive dust deposits, eventually leading to flashovers.

In another electrostatic filter cell, a corrugated, dielectric filter material web is also disposed in a cardboard frame. The electrostatic field is obtained through an electrically conducting material applied in the form of strips to the combs of the corrugated filter material web. The application of a voltage of opposite polarity to the opposite outsides of the filter cell generates the electrostatic field through which the efficiency of the floating particles filter is improved (French Pat. No. 11 07 132).

Disadvantageously there is the free area between the conducting strips through which small quantities of the floating particles can pass.

SUMMARY OF THE INVENTION

The invention provides an electrostatic filter which increases the filtering efficiency even further and which assures that even in the event of a power failure the floating particles retained at the electrode on the discharge side can subsequently not pass into the purified air flow.

According to the invention, the electrode on the air discharge side comprises a metallic vapor deposit on the filter material and that, in further development, this vapor deposit comprises a copper and silver mixture.

An advantage of the invention is that floating particles which still passed through the filter material and are then retained by the vapor deposited electrode are still within the filter material. They are not blown away and thus enter the purified air flow, even in the event of a power failure.

Accordingly, it is an object of the invention to provide an improved electrostatic filter for floating particles in which an electrode comprises a folded dielectric filter fabric material having a metallic vapor deposited thereon.

A further object of the invention is to provide a filter which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings in which a preferred embodiment of the invention is illustrated.

BRIEF DESCRIPTION OF THE DRAWINGS

In the drawings:

The only FIGURE of the drawings is a transverse sectional view of an electrostatic filter for floating particles constructed in accordance with the invention.

DESCRIPTION OF THE PREFERRED EMBODIMENT

Referring to the drawings, in particular the invention embodied therein comprises an electrostatic filter for floating particles which comprises a housing or frame 3 having an inlet opening at the end adjacent the arrow 4 and an outlet opening at the opposite end adjacent the arrow 6 with a fluid flow path defined therebetween. Respective oppositely charged first and second electrodes 5 and 1 extend across the fluid flow path at spaced locations in the flow path and one of these electrodes, electrode 1 comprises a folded dielectric filter fabric material having a metallic vapor deposited thereon.

The dielectric filter material of electrode 1, made of fibers, is cemented, at its two ends, into sealing compound layer 2 and in a frame 3 which is made of wood, cardboard or metal. The corrugated electrode 1 has opposite elongated ends shown in the FIGURE which are fully embedded within the sealing compound layer 2. It is folded in order to increase the active surface. Disposed on the air entry side as shown by arrow 4 is a grounded electrode 5 in the form of a screen.

The air discharge designated by arrow 6 leaves electrode 1. The fibers of electrode 1 have a metallic vapor deposit thereon of a copper and silver mixture so that the electrode 1 acts as an electrode when it is connected to a power supply. Therefore, the filter material remains air permeable. The voltage source is connected to the vapor deposit via a conducting connection 8. Due to the electrostatic field set up around the electrode 1 through the oppositely polarized electrodes the degree of separation is improved substantially.

While a specific embodiment of the invention has been shown and described in detail to illustrate the application of the principles of the invention, it will be understood that the invention may be embodied otherwise without departing from such principles.

What is claimed is:

1. An electrostatic filter for filtering out floating particles comprising:

a housing defining a space and having an inlet opening on one side and an outlet opening on an opposite side with a fluid flow path between said inlet and outlet openings;

a flat screen connected to said frame and covering said inlet opening, said screen acting as a first electrode and being grounded;

a corrugated dielectric filter made of fabric material with filaments which have a metallic vapor deposit thereon of a copper and silver mixture, disposed in said housing between said first electrode and said outlet opening and across said fluid flow path and forming a second electrode, said second electrode having opposite elongated ends;

a cement sealing layer connected to said housing on each side thereof opposite said fluid flow path and in said space, said elongated ends of said second electrode being embedded respectively in each of said cement sealing layers for holding said second electrode across said fluid flow path; and a voltage source connected to said second electrode for applying a voltage thereto.

* * * * *